US005580335A

United States Patent [19]

Smith, IV

[11] Patent Number: 5,580,335

[45] Date of Patent: Dec. 3, 1996

[54] EXERCISE DEVICE

[75] Inventor: Christopher J. B. Smith, IV, Oceanport, N.J.

[73] Assignee: Prism Enterprises, Inc., San Antonio, Tex.

[21] Appl. No.: 357,463

[22] Filed: Dec. 16, 1994

[51] Int. Cl.[6] ..... A63B 23/00

[52] U.S. Cl. ..... 482/44; 601/40

[58] Field of Search ..... 482/45–46, 44, 482/47; 601/124, 123, 122, 121, 120, 119, 118, 40; 24/488–17B

[56] References Cited

U.S. PATENT DOCUMENTS

| | | | |
|---|---|---|---|
| 2,007,737 | 7/1935 | Anderson | 601/122 |
| 2,219,138 | 10/1940 | Morrison | 482/44 |
| 2,310,804 | 2/1943 | Morrison | 482/44 |
| 3,779,548 | 12/1973 | Sato | 482/44 |
| 4,023,808 | 5/1977 | Hebert | 482/126 |
| 4,345,757 | 8/1982 | LoVoi | 601/121 |
| 4,577,858 | 3/1986 | Higami | 482/45 |
| 4,964,630 | 10/1990 | Curtiss . | |
| 5,299,991 | 4/1994 | Sato . | |

*Primary Examiner*—Stephen R. Crow
*Attorney, Agent, or Firm*—Leydig, Voit & Mayer Ltd.

[57] ABSTRACT

An exercise device including a pair of hollow cylindrical rollers interconnected so as to be maintained in generally line rolling engagement whereby upon the rollers being rotated by the hand of the person the person's fingers, thumb and hand are exercised, and if squeezed more tightly during rotation, the rollers also impart exercise to the wrist and forearm.

5 Claims, 2 Drawing Sheets

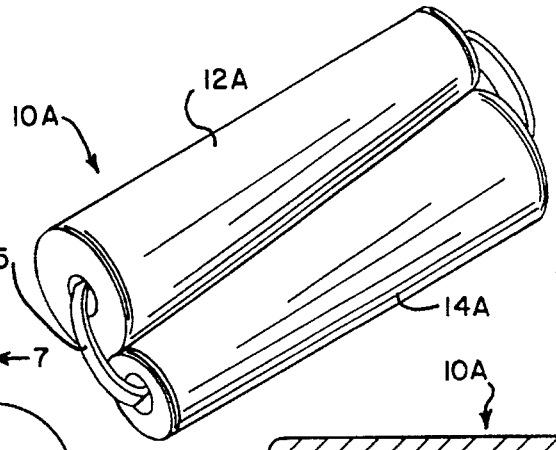
FIG. 5
FIG. 6
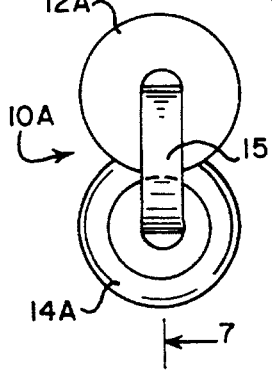
FIG. 7
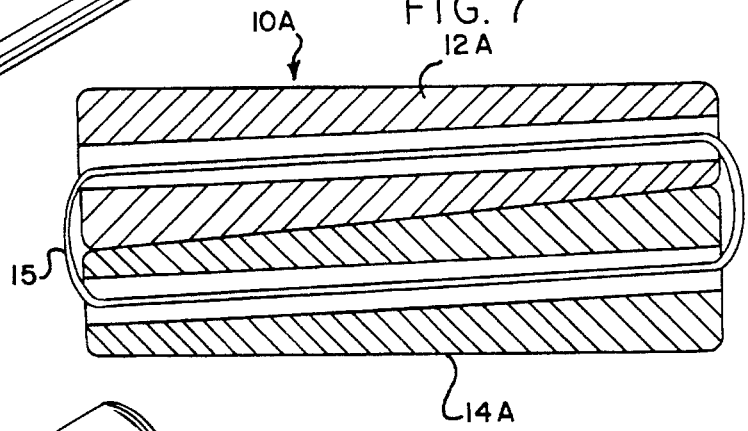
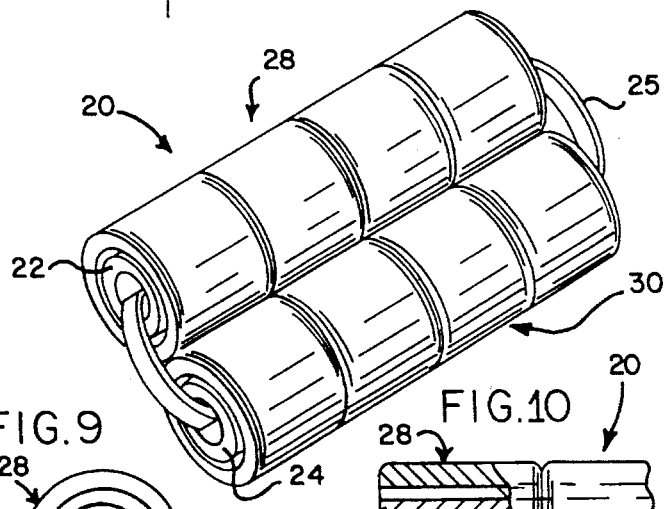
FIG. 8
FIG. 9
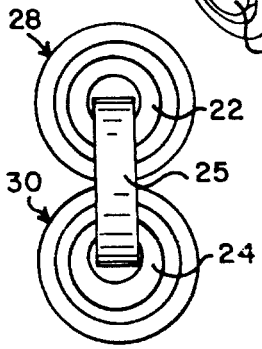
FIG. 10
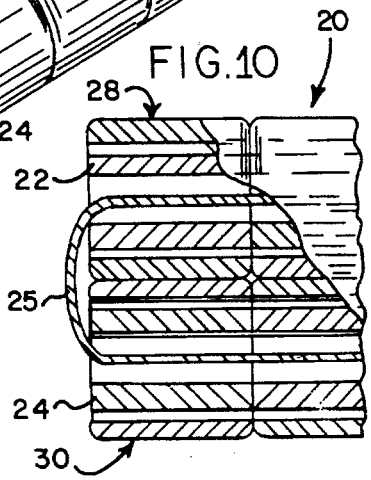
FIG. 11
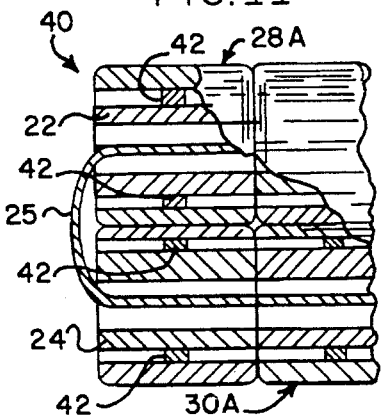

EXERCISE DEVICE

EXERCISE DEVICE

This invention relates generally to an exercise device and more particularly relates to an exercise device for the hand, fingers and thumb of a person and, depending on manner of use, also for the wrist and forearm of a person.

Numerous hand and finger exercise and training devices are known to the prior art. U.S. Pat. No. 3,779,548, entitled FINGER-TRAINING APPARATUS, patented Dec. 18, 1973, discloses finger-training apparatus which is complex and expensive to manufacture due to the requirement of having to manufacture numerous separate parts and due to the attendant expense of parts assembly. U.S. Pat. No. 4,577,853, entitled FINGER TIP EXERCISER, patented Mar, 25, 1986, discloses a finger tip exerciser comprising a pair of balls having bores through which the balls are connected together rotatably; this device is complex and has the limitation that it exercises only the finger tips of a person. U.S. Pat. No. 4,964,630, entitled EXERCISE DEVICE, patented Oct. 23, 1990, discloses two elongated, unconnected, cylindrically shaped members for the exercise of the hands, fingers and thumbs; the cylindrical members have a hollow internal core filled with particulate mass bearing material are essentially disconnected and have the undesirable feature of possibly misplacing or losing one cylindrical member causing the loss of the benefit of exercise provided by the two cylindrical members. Another device that has been used to exercise the hands, fingers, and thumbs comprises two unconnected hollow metal cylinders. Upon use, these cylinders would be rolled about one another using only one hand. However, as was the case with respect to the cylinders disclosed in U.S. Pat. No. 4,964,630, these cylinders also have the undesirable feature of potential loss of one of the cylinders because they are not connected to one another. U.S. Pat. No. 5,299,991, entitled FINGER TRAINING DEVICE, patented Apr. 5, 1994, discloses a finger training device which is complex, made of numerous separate parts which must be assembled together making the device undesirably complex and costly to maintain.

Accordingly, there exists a need in the art for a new and improved exercise device which can be manufactured and assembled comparatively inexpensively and which maintains the separate elements comprising the device in a connected relationship at all times.

SUMMARY OF THE INVENTION

It is the object of the present invention to satisfy the foregoing need in the art.

An exercise device satisfying the foregoing need and embodying the present invention includes a pair of hollow cylindrical rollers interconnected so as to be maintained in generally line rolling engagement whereby upon the rollers being rotated by the hand of the person the person's fingers, thumb and hand are exercised, and if squeezed more tightly during rotation, the rollers also impart exercise to the wrist and forearm. A further embodiment of the device includes a plurality of secondary hollow cylindrical members surrounding each of the above-noted cylindrical members in rolling engagement thereby enhancing the rolling feature of the device and enhancing its ability to provide the above-noted exercise.

DESCRIPTION OF THE DRAWINGS

FIG. 5 is a perspective view of an alternate embodiment of the exercise device of the present invention in which the rollers are frusto-conical;

FIG. 6 is a right end view of the exercise device of FIG. 5;

FIG. 7 is an enlarged longitudinal cross-sectional view of the exercise device of FIG. 5;

FIG. 8 is an alternate embodiment of the exercise device of the present invention;

FIG. 9 is an end view of the exercise device of FIG. 8;

FIG. 10 is a partial longitudinal cross-sectional view of the exercise device of FIG. 8; and FIG. 11 is a partial longitudinal cross-sectional view of a still further alternate embodiment of the exercise device of the present invention.

DESCRIPTION OF THE PREFERRED EMBODIMENTS

Figure 1:
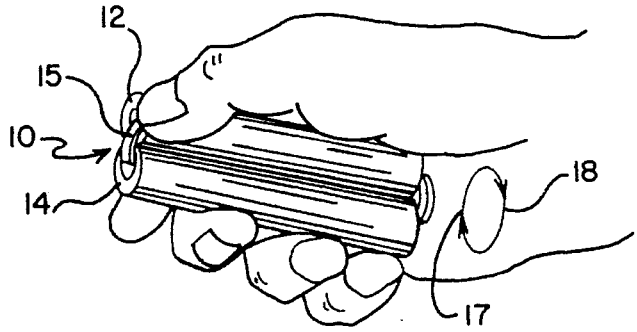
FIG. 1 is a diagrammatical view, in perspective, illustrating the manner in which the first embodiment of the exercise device of the present invention may be held in the hand of a person for exercise.
Figure 2:
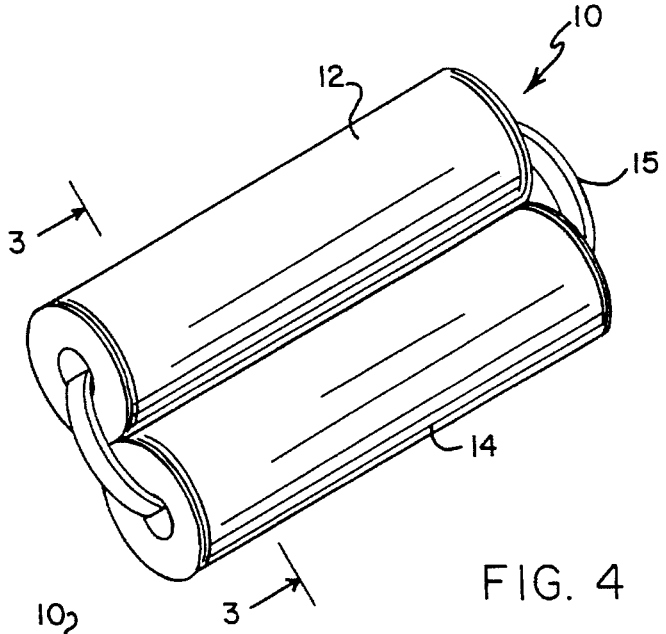
FIG. 2 is an enlarged perspective view of the exercise device of FIG. 1.
Figure 3:
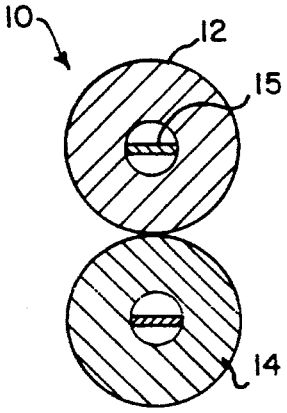
FIG. 3 is an enlarged transverse cross-sectional view of the exercise device shown in FIG. 3 taken along the line 3—3 in the direction of the arrows.
Figure 4:
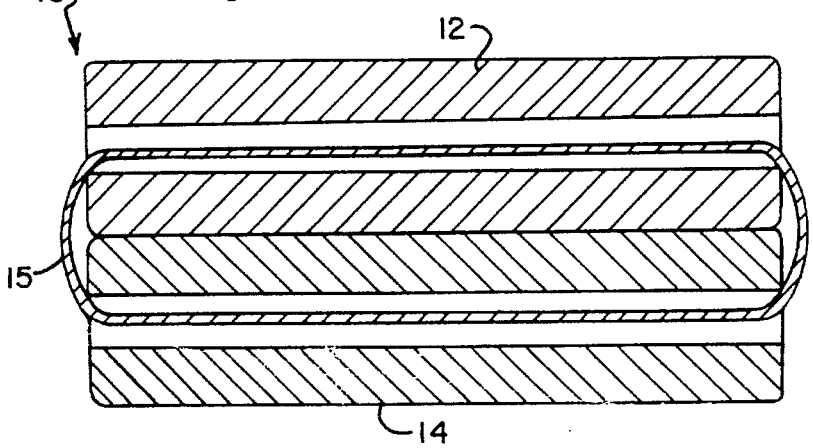
FIG. 4 is an enlarged longitudinal cross-sectional view of the exercise device of FIG. 3.

Referring to FIGS. 1–4, there is shown an exercise device embodying the present invention and indicated by general numerical designation 10. Exercise device 10 includes a pair of longitudinally extending cylindrical members 12 and 14 and an endless strap 15 extending through the bores and generally around the opposite ends of the cylindrical members. The strap 15 places the outer cylindrical surfaces of the cylindrical members 12 and 14 in generally line contact and maintains the cylindrical members in rolling engagement with each other upon the members being rolled around each other by the thumb and fingers of a person as illustrated diagrammatically in FIG. 1 by the curved and interconnected arrows 17 and 18. It will be understood that upon the rollers 12 and 14 being rolled around each other exercise is imparted to the hand, fingers and thumb of a person and, upon the rollers being squeezed inwardly as they are being rolled, exercise also may be imparted to the wrist and forearm of a person. As will best be understood by reference to FIG. 3, the transverse width of the endless strap 15 is less than the diameter of the cylindrical bores formed through the cylindrical members 12 and 14. The endless strap 15 may be made of a suitable plastic material by taking a length of such material and adhering the ends together such as by a suitable adhesive or such as by suitable heat and pressure. The length of the strap 15 is such that it places the outer cylindrical surfaces of the cylindrical members 12 and 14 in generally line contact and maintains the cylindrical members in rolling engagement upon rotation being imparted to the members as described above.

An alternate embodiment of the exercise device of the present invention is shown in FIGS. 5–7 and indicated by general numerical designation 10A. Exercise device 10A is substantially similar to exercise device 10 described above, except that exercise device 10A includes a pair of frusto-conical cylindrical members 12A and 14A as shown particularly in FIGS. 5 and 7. It will be noted that the smaller end of each of the frusto-conical cylindrical members 12A and 14A is disposed opposite the larger end of the other cylindrical member. The connecting endless strap 15 of FIG. 1 is included with this embodiment, and it performs the same function as described above with regard to the exercise device 10.

A further embodiment of the exercise device of the present invention is shown in FIGS. 8–10 and indicated by general numerical designation 20. Exercise device 20 includes a pair of longitudinally extending primary cylindrical members 22 and 24 having a cylindrical bore extending longitudinally therethrough and extending through such bores is an endless connecting strap 25 which may be substantially the same as the endless connecting strap 15 described above except that endless connecting strap 25 is longer in length. Surrounding the primary cylindrical members 22 and 24, respectively, are pluralities of additional hollow cylindrical members indicated by general numerical designations 28 and 30. As best may be understood by reference to FIG. 10, the axial length of each of the additional cylindrical members of the pluralities 28 and 30 is smaller than the axial length of the primary cylindrical members 22 and 24 and it will be understood that the inner diameters of the pluralities of additional hollow cylindrical cylinders 28 and 29 is larger than the outer diameter of the inner primary cylindrical members 22 and 24. The spacing between the primary and additional cylindrical members shown in FIG. 10 has been enlarged for clarity of presentation, but it will be understood that the difference between the inner diameters of the additional cylindrical members 28 and 29 is only slightly larger than the outer diameter of the inner primary cylindrical members 22 and 24 and the difference is sufficiently large to permit only free rolling of the outer cylindrical members around the inner cylindrical members upon rotation being imparted to the outer and inner cylindrical members as indicated by the arrows 17 and 18 in FIG. 1. It has been discovered that the inclusion of the additional outer pluralities of cylindrical members 28 and 30 enhances the rolling action of the exercise device 20 and enhances the exercise which may be imparted to the hand, fingers, thumb, wrist and forearm of a person.

A still further embodiment of the exercise device of the present invention is illustrated in FIG. 11 and indicated by general numerical designation 40. Exercise device 40 is substantially the same as exercise device 20, except that the inner bores of the outer pluralities additional cylindrical members 28A and 30A are provided with inwardly extending ridges, note ridges 42 shown in FIG. 10, which cause the outer additional cylindrical members to generally engage the inner primary cylindrical members 22 and 24 in substantially line contact, instead of substantially area contact, thereby enhancing the rolling engagement between the outer and inner cylindrical members. The ridges 42 may be generally rectangular in cross-section as shown in FIG. 11, or alternatively, the ridges may be conical or triangular in cross-section.

It will be understood that many variations and modifications of the present invention may be made without departing from the spirit and the scope thereof.

What is claimed is:

1. An exercise device comprising at least two longitudinally extending cylindrical members each having a longitudinal axis and a cylindrical bore extending longitudinally through the member; and connecting means comprising an endless strap extending through said bores and generally around the opposite ends of said members which allows the longitudinal axes of the members to be independently rotatable with respect to one another, wherein said connecting means places the outer cylindrical surfaces of said members in generally line contact with each other and maintains said cylindrical members in rolling engagement with each other when the longitudinal axes of the members are rotated with respect to one another.

2. The exercise device according to claim 1, wherein the outer shape of said members is frustoconical and the smaller end of each member is disposed opposite the larger end of an adjacent member.

3. The exercise device according to claim 1, wherein the endless strap has a transverse cross-sectional width which is less than the diameter of the cylindrical bore of the cylindrical members.

4. An exercise device comprising a pair of longitudinally extending primary cylindrical members each having a predetermined axial length, a cylindrical bore extending longitudinally through the primary member, and an outer cylindrical surface of a predetermined diameter;

a plurality of secondary cylindrical members each having an axial length which is less than the axial length of each primary cylindrical member, an outer cylindrical surface, and a central bore of a predetermined diameter extending longitudinally through the secondary member, wherein the diameter of the central bore of each secondary cylindrical member is greater than the outer cylindrical diameter of each primary cylindrical member, each primary cylindrical member having at least one secondary cylindrical member rotatably surrounding the outer cylindrical surface of the primary cylindrical member, and connecting means extending through said central bores of each primary cylindrical member and generally around the opposite ends of the members, the connecting means placing the outer cylindrical surface of at least one secondary cylindrical member surrounding one primary cylindrical member in generally line contact with the outer cylindrical surface of at least one secondary cylindrical member surrounding another primary cylindrical member, the connecting means further maintaining those secondary cylindrical members which are in generally line contact with one another in rolling engagement with one another when those secondary cylindrical members are rotated with respect to one another.

5. The exercise device according to claim 4, wherein at least one secondary cylindrical member is provided with at least one annular ridge which extends generally inwardly into the central bore of the secondary cylindrical member and engages the outer cylindrical surface of the primary cylindrical member surrounded by the at least one secondary cylindrical member.

* * * * *